US005676823A

United States Patent [19]

McKay et al.

[11] Patent Number: 5,676,823

[45] Date of Patent: Oct. 14, 1997

[54] SPARGER SYSTEM INCLUDING JET STREAM AERATOR

[75] Inventors: Jeffrey D. McKay, South Jordan; Randy A. Ynchausti, Centerville; Paul M. Keyser, Salt Lake City, all of Utah

[73] Assignee: Baker Hughes Incorporated, Houston, Tex.

[21] Appl. No.: 612,060

[22] Filed: Mar. 7, 1996

[51] Int. Cl.[6] ..... B03D 1/24; B01F 3/04

[52] U.S. Cl. ..... 209/170; 210/220; 210/221.2; 261/64.3; 261/121.2; 261/122.2

[58] Field of Search ..... 209/170; 210/221.2, 210/221.1, 220; 261/122.2, 64.3, 121.1

[56] References Cited

U.S. PATENT DOCUMENTS

| | | |
|---|---|---|
| 2,767,510 | 10/1956 | Hopkins . |
| 3,446,488 | 5/1969 | Mail . |
| 3,542,675 | 11/1970 | Mail . |
| 3,651,646 | 3/1972 | Grunau . |
| 3,679,056 | 7/1972 | Haymore . |
| 4,313,680 | 2/1982 | Honnen . |
| 4,382,867 | 5/1983 | Schrit . |
| 4,534,914 | 8/1985 | Takahashi . |
| 4,585,031 | 4/1986 | Raftis . |
| 4,607,663 | 8/1986 | Raftis . |
| 4,752,383 | 6/1988 | McKay et al. . |
| 4,911,826 | 3/1990 | Harach et al. . |
| 4,940,534 | 7/1990 | Harrison . |
| 4,971,731 | 11/1990 | Zipperian . |
| 5,078,921 | 1/1992 | Zipperian . |
| 5,356,533 | 10/1994 | Nakagawa . |
| 5,378,355 | 1/1995 | Winkler . |
| 5,397,001 | 3/1995 | Yoon . |
| 5,456,362 | 10/1995 | Laskowski et al. . |

OTHER PUBLICATIONS

Minnovex Variable Gap Sparger Operation and Maintenance Manual; Jul. 1, 1994; pp. 1–6.

TIDEFLEX™ All-Rubber Check Valve Installation, Operation and Maintenance Manual; pp. 1–8.

*Primary Examiner*—Thomas M. Lithgow

*Attorney, Agent, or Firm*—Trask, Britt & Rossa

[57] ABSTRACT

A sparging system assembly having an improved nozzle for use in a flotation separation column. The sparging system of the present invention uses an elastomeric check valve type nozzle to form the desired size of flotation bubbles in the column. The system further comprises an installation configuration and valving arrangement for the easy, efficient replacement of any worn or damaged elastomeric check valve type nozzle during the operation of the flotation separation column.

24 Claims, 4 Drawing Sheets

SPARGER SYSTEM INCLUDING JET STREAM AERATOR

BACKGROUND OF THE PRIOR ART

1. Field of the Invention

The present invention relates to aeration devices used in flotation separation processes. More specifically, the present invention relates to a sparger system assembly having an improved nozzle for use in a flotation separation column.

2. State of the Art

Flotation columns are typically used in the froth flotation concentration of minerals. In froth flotation concentration in a column, finely divided ore, containing mineral and gangue, is suspended in a liquid being injected together with reagents into a flotation column at a predetermined distance from the top of the column, the column typically having a plurality of vertically extending baffles therein. At the bottom of the column, air is injected to form small air bubbles which subsequently rise to the top of the column carrying minerals on the surface thereof to the overflow portion of the column. Wash water may enter the top of the column to facilitate or wash down the gangue to the bottom of the column and subsequent removal therefrom.

Typically, a fluid is injected, substantially at the bottom of the separation flotation column, such fluid including aerated water, gas, air, with or without water vapor or droplets, and with or without a suitable reagent, such as frothers. For descriptive purposes hereinafter, the term air will be used, but it is to be understood other suitable gas or gases could be used, with or without water, and with or without reagents. For efficient operation of the column, the air should be injected into the column uniformly across the cross section thereof generally to form as small a diameter of bubble as practical to support the mineral on the surface thereof for transport during the separation process to the overflow portion of the column located at the top thereof. To improve the separation operation of the column, vertical baffles are used to help minimize any fluid recirculation throughout the column which is detrimental to the performance of the column during the flotation separation process. With the inclusion of vertical baffles in the column it is even more important that the air be injected uniformly into the column below the baffles.

To effect the injection of air into the column various devices, such as spargers, injectors, aspirators, nozzles and bubble generators, are commonly used. While the bubble size is generally related to the size of the particles to be separated from the ore in the column, highly uniform, small diameter bubbles are required to efficiently float fine mineral particles for removal to the overflow located at the top of the column.

Spargers are well known for use in the separation of minerals from gangue in froth separation, such as various types of ring spargers to distribute aerated water. Typically, such sparging systems use one or more distribution rings of nozzles to supply air into and across the column. In some instances, rather than supplying aerated water to the column, air is supplied to the column to form the required flotation bubbles.

When either aerated water or air is supplied to the column for forming the flotation bubbles, for efficient bubble formation, the aerated water or air is supplied under relatively high pressure. This together with the flow of the slurry in the column which is typically highly abrasive, over time, causes the erosion and/or corrosion of the nozzles used within the column. Several types of nozzle designs have been tried to minimize such erosion and/or corrosion problems and the attendant decline in column performance as well as the efficient repair and replacement of the affected nozzles.

In one prior art sparger system, as disclosed in U.S. Pat. No. 4,911,826, the perforated sparger pipes contain replaceable wear resistant nozzles therein to improve the life thereof. However, the sparger pipes containing the nozzles are difficult to repair during the operation of the column. Moreover, the small orifices of these prior nozzles plug easily with debris from the slurry, or the air or water supply.

Another type sparger system used in flotation separation columns employs a plug type wear resistant plug body, which is adjustable, to vary the size of the bubbles generated and the flow through the nozzle. However, the wear resistant plug body is expensive to replace. Also, the adjustability feature is of limited value as it is difficult to detect changes in column performance.

A need exists for a simple, inexpensive, easily replaceable, self regulating, self cleaning sparging system for use in flotation separation columns.

SUMMARY OF THE INVENTION

The present invention relates to aeration devices used in flotation separation processes. More specifically, the present invention relates to a sparging system assembly having an improved nozzle for use in a flotation separation column. The sparging system of the present invention uses a self regulating, self-cleaning check valve type nozzle of flexible material to form the desired size of flotation bubbles in the column. The system further comprises an installation configuration and valving arrangement for the easy, efficient replacement of any worn or damaged flexible check valve type nozzle during the operation of the flotation separation column.

BRIEF DESCRIPTION OF THE DRAWINGS

The present invention will be better understood when the description of the invention is taken in conjunction with the drawings wherein.

DESCRIPTION OF THE INVENTION

Figure 1:
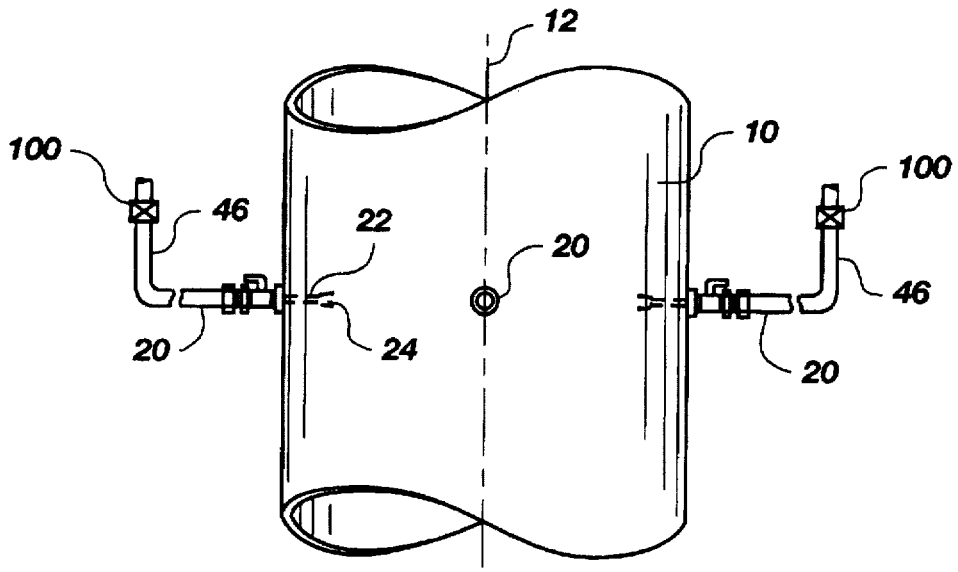
FIG. 1 is a side view of a portion of a flotation column with the sparger system of the present invention installed therein.

Referring to drawing FIG. 1, shown is a portion of a flotation separation column 10, having a central axis 12 therein, including a plurality of sparger system assemblies 20 of the present invention installed thereon. The flotation separation column 10 is shown to be generally cylindrical and being of suitable size and height for the desired separation process. Other shapes of columns (not shown) are also contemplated for the use of aeration devices including the present invention. The flotation separation column 10 may further include a plurality of vertical baffles therein (not shown) to help prevent recirculation of the slurry therein. Depending upon the size of the flotation separation column 10 and the separation process parameters, the number of sparger system assemblies 20 will vary. In general, the sparger system assemblies 20 are installed near the bottom of the flotation separation column being uniformly circumferentially distributed therearound. As shown, each sparger system assembly 20 includes a sparger pipe 22 having a nozzle 24 thereon extending into the flotation separation column 10 a predetermined distance depending upon the size of the column 10 and the separation process parameters. Also shown connected to each sparger system assembly 20 is a valve 100 located in the supply pipe 46 to each sparger system assembly 20. The valve 100 may be of any suitable type for use in the fluid supply through the supply pipe 46 to the flotation separation column 10.

Figure 2:
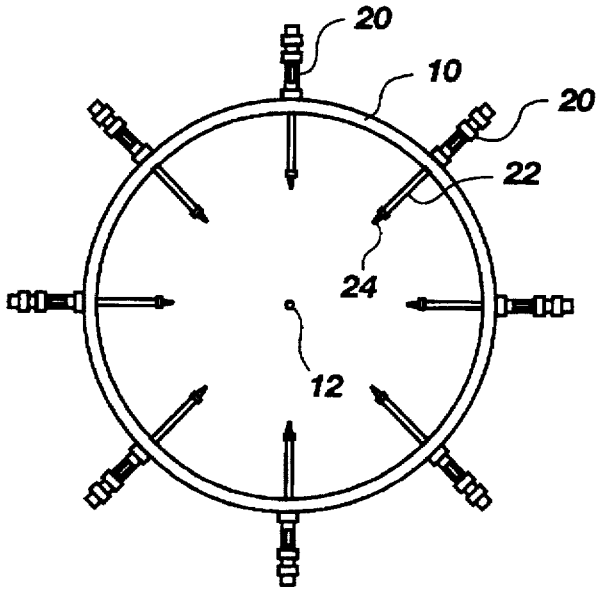
FIG. 2 is a top view of a portion of a flotation column with the sparger system of the present invention installed therein.

Referring to drawing FIG. 2, the portion of the flotation separation column 10, having central axis 12 therein, is shown in a top view. The flotation separation column 10 has a plurality of uniformly circumferentially spaced sparger system assemblies 20 located therein. As shown, each sparger assembly 20 has a sparger pipe 22 having a nozzle 24 thereon extending a predetermined distance into the column 10. Not shown are the supply pipe portions which include the valves 100 therein.

Figure 3:
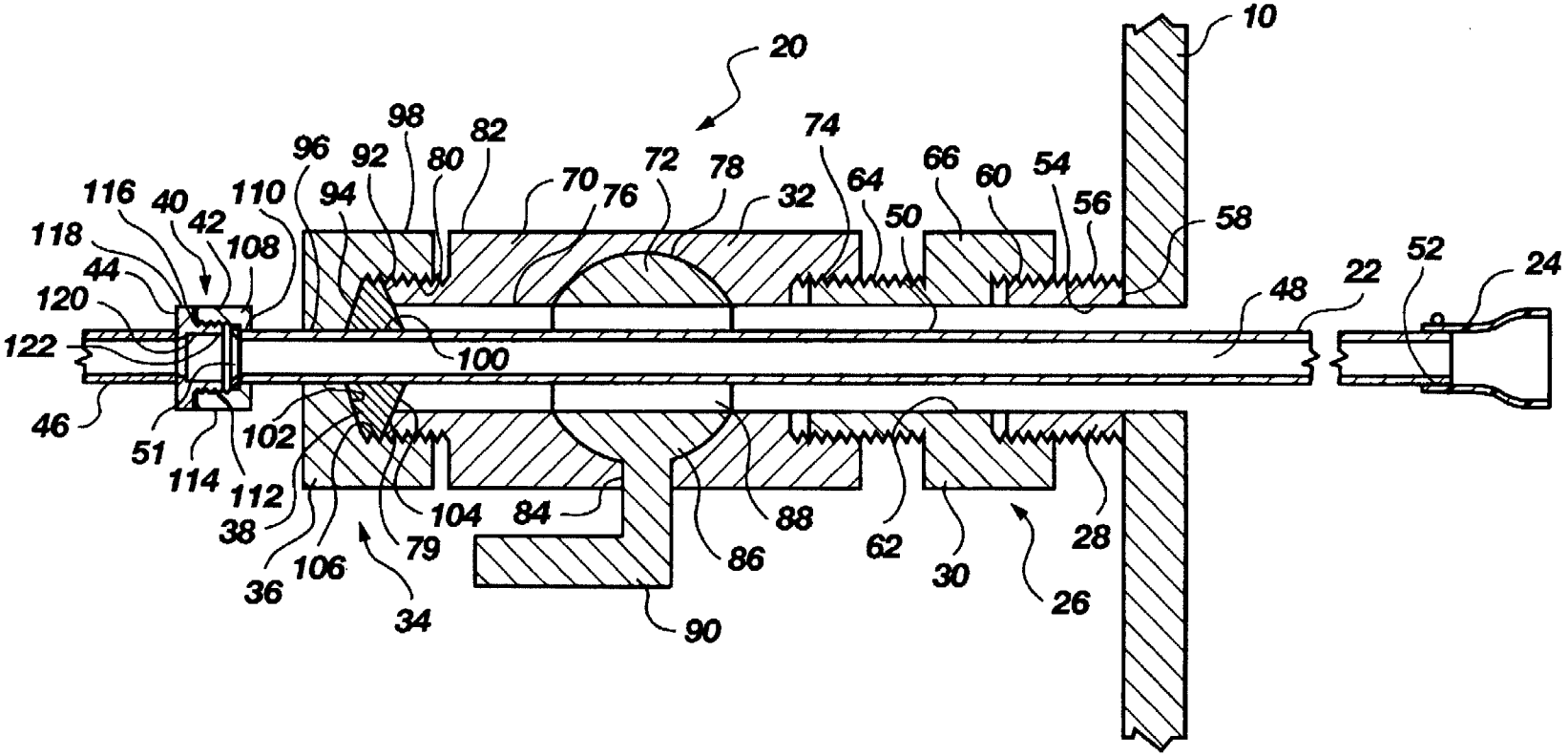
FIG. 3 is cross-sectional view of the sparger system of the present invention installed on a flotation column.

Referring to drawing FIG. 3, each sparger system assembly 20 comprises a sparger pipe 22, nozzle 24, column connector assembly 26 which includes male connector body 28 and female connector receptacle 30, valve assembly 32, compression fitting assembly 34 which includes compression fitting 36 and compression seal 38, sparger pipe connector assembly 40 which includes female connector receptacle 42 and male connector body 44, and sparger supply pipe 46.

The sparger pipe 22 comprises an elongated annular cylindrical member having a predetermined length, bore 48 therethrough, exterior surface 50 having, in turn, flared frusto-conical end 51 thereon, and one or more frusto-conical surfaces (not shown) on the exterior of end 52 to facilitate the connection of the nozzle 24 thereto. The pipe 22 may be constructed of any desired material suitable for use in the flotation separation column 10, such as steel, stainless steel, plastic, alloys of steel and stainless steel, etc.

The column connector assembly 26 comprises a male connector body 28 and female connector receptacle 30. The male connector body 28 comprises a cylindrical annular member having a bore 54 therethrough, threaded exterior surface 56 thereon, and an end 58 secured to a portion of the exterior of the floatation separation column 10. The male connector body 28 may be secured to the exterior of a portion of the flotation column 10 by any suitable means, such as welding, bolts, rivets, etc. The female connector receptacle 30 comprises an annular cylindrical member having threaded bore 60 which threadedly engages threaded exterior surface 56 of the male connector body 28, bore 62 which is substantially the same diameter as bore 54 of the male connector body 28, threaded exterior surface 64, and exterior surface 66 which may include suitable wrenching flats thereon (not shown). The male connector body 28 and female connector receptacle 30 may be made of any suitable material for use in the sparging system assembly, such as steel, stainless steel, plastic, etc.

The valve assembly 32 comprises any suitable valve member for use in the sparging system assembly 20. As shown, the valve assembly 32 comprises an annular housing 70 and ball valve member 72 located therein. The annular housing 70 comprises an annular cylindrical member having threaded bore 74 therein which threadedly engages the threaded exterior surface 64 of the female connector receptacle 30, bore 76 being substantially the same diameter as the bore 62 of the female connector receptacle 30 and having spherical ball valve recess 78 located in a portion thereof, threaded exterior portion 80, frusto-conical surface 79, and exterior surface 82 having an aperture 84 therein. The ball valve member 72 comprises a generally spherical valve body ball 86 being substantially the same diameter as the spherical ball valve recess 78 located in a portion of the bore 76 of annular housing 70, bore 88 therethrough being substantially the same diameter as the bore 76 of the annular housing 70, and valve actuator 90 having a portion thereof extending through the aperture 84 in the exterior surface 82 of annular housing 70. The valve assembly 32 may be made of any suitable materials for use in the sparging system assembly 20, such as steel, stainless steel, plastic, etc.

The compression fitting assembly 34 comprises compression fitting 36 and compression seal 38. The compression fitting 36 comprises and annular cylindrical member having a threaded bore 92 therein which threadedly engages with threaded exterior surface 80 of annular housing 70, frusto-conical surface 94, bore 96 and exterior surface 98 which may include wrenching flats thereon (not shown). The compression seal 38 comprises an annular cylindrical member having a bore 100 therethrough which sealing engages the exterior surface 50 of the sparger pipe 22, first frusto-conical surface 102 which is complementary to the frusto-conical surface 94 of the compression fitting 36, second frusto-conical surface 104 which is complementary with frusto-conical surface 79 of annular housing 70 and exterior surface 106 which is substantially the same diameter as the threaded bore 92 of compression fitting 36. The compression fitting 36 may be made of any suitable material for use in the sparger system assembly 20, such as steel, stainless steel, etc. The compression seal 38 may be of any suitable material for use as a compression type seal, such as elastomeric material, nylon, brass, etc.

The sparger pipe connector assembly 40 includes female connector receptacle 42 and male connector body 44. The female connector receptacle 42 comprises an annular cylindrical member having an annular shoulder 108 having, in turn, a bore 110 therethrough which mates with frusto-conical surface 51 on the end of sparger pipe 22, threaded bore 112, and exterior surface 114 which may include wrenching flats therein (not shown). The male connector body 44 comprises an annular cylindrical member having a bore 116 therethrough which is substantially the same diameter as bore 48 of sparger pipe 22, annular shoulder 118, threaded exterior surface 120 which threadedly engages threaded bore 112 of female connector receptacle 42, and frusto-conical end surface 122 which engages the interior of frusto-conical end 51 of the sparger pipe 22. The female connector body 44 and male connector body 44 may be made of any suitable materials for use in the sparger system assembly 20, such as steel, stainless steel, plastic, etc.

The sparger supply pipe 46 is connected to the male connector body 44 by any suitable means as may be desired for use in the sparger system assembly 20. The sparger supply pipe 46 may be a metal pipe, elastomeric pipe, etc. depending upon the operating conditions and parameters of the sparger system assembly 20 and the flotation separation column 10.

Figure 4:
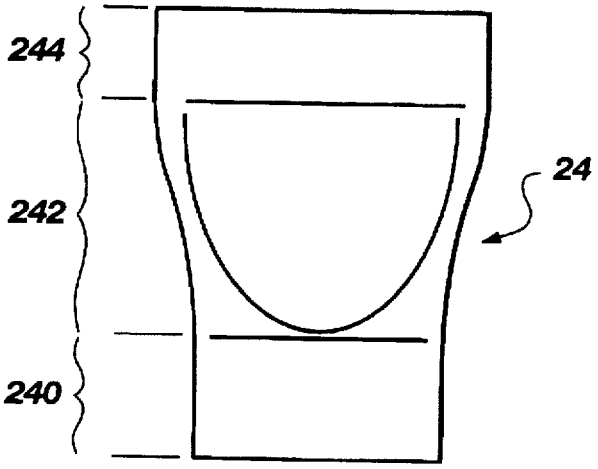
FIG. 4 is a side view of the check valve type nozzle used in the sparger system of the present invention.

Referring to drawing FIG. 4, the nozzle 24 of the sparging system assembly 20 is shown. The nozzle 24 comprises an elastomeric duck bill type check valve nozzle which is self regulating with respect to flow therethrough and self cleaning. The nozzle 24 includes a cuff portion 240 at one end thereof having a substantially full round bore therethrough to resiliently slip over the end 52 of the sparger pipe 22, a saddle portion 242 in the middle portion of the nozzle 24 which tapers from the substantially full round bore of cuff portion 240 to the substantially flat bill portion 244 thereby forming a generally tapered cross-sectional shape, and a bill portion 244 which is substantially flat and has a slit 246 therethrough to allow fluid flow therethrough. While the orientation of the slit 246 is shown in the drawings to be vertical, it should be understood that the slit 246 orientation could be in any suitable direction within the separation flotation column. The saddle portion 242 directs fluid flow to the bill portion and is resilient to sustain the shape thereof in response to any substantial increase in the fluid flow conditions through the nozzle 24. The bill portion 244 flexes to allow fluid flow through the substantially longitudinal slit 246 therein and is resilient to prevent the bill portion 244 from opening without sufficient fluid pressure being applied to the to the nozzle 24. The slit 246 may be of any suitable length, such length including the range of substantially one-eighth inch in length to a length of the width of the bill portion 244 of the nozzle 24. The nozzle 24 may be made of any suitable flexible or elastomeric material, such as rubber, neoprene, ceramics, composites, etc. suitable for use in the flotation separation process, and may include fabric or wire reinforcing 248 therein as required. The nozzle 24 is self cleaning since any build-up of material thereon will be removed by the flexing of the nozzle by the fluid flow therethrough. The nozzle 24 is further self regulating with respect to the flow of fluid therethrough as the resiliency of the nozzle and the flexure of the nozzle 24 in reaction to the fluid therearound will determine the potion of the bill 244 of the nozzle 24 through which the fluid flows during the operation of the nozzle.

Figure 5:
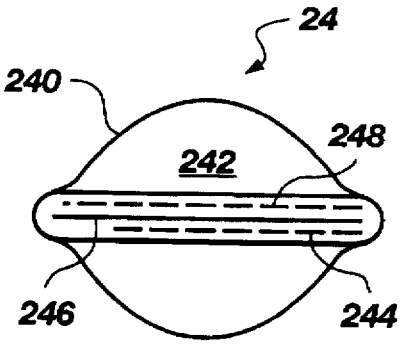
FIG. 5 is an end view of the check valve type nozzle used in the sparger system of the present invention.

Referring to drawing FIG. 5, the nozzle 24 is shown in an end view illustrating the substantially longitudinal slit 246 in the bill portion and the reinforcement 248 thereof. The bill portion 244 of the nozzle 24 is substantially the width of the cuff portion 240 if the cuff portion were flattened from its substantially cylindrical shape of the full round bore configuration.

Figure 6:
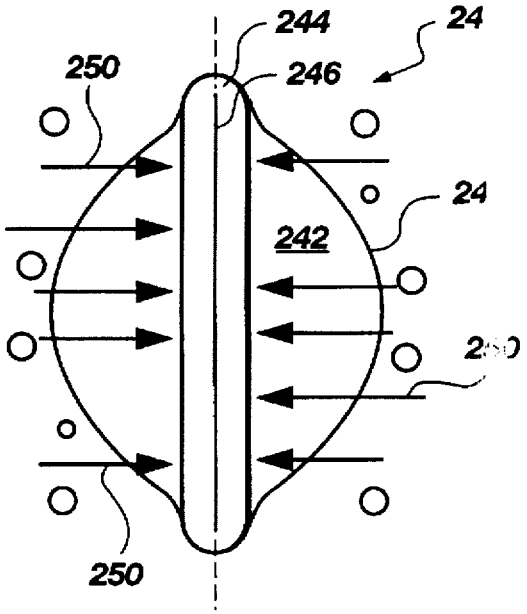
FIG. 6 is an end view of the check valve type nozzle of the sparger system of the present invention during operation thereof in a flotation column.

Referring to drawing FIG. 6, the nozzle 24 is shown in relationship to the fluid slurry surrounding the nozzle 24 when in use in the flotation separation column 10. The nozzle 24 is installed on the end 52 of the sparger pipe 22 with the substantially longitudinal slit 246 shown to be, for example, oriented to be substantially vertical with respect to the central axis of the flotation separation column 10. In this manner, the fluid pressure of the fluid slurry in the flotation separation column 10 surrounding the nozzle 24 acts substantially uniformly on each side of the bill potion 244 of the nozzle 24 to cause the substantially longitudinal slit 246 to be closed blocking any fluid flow thereinto when no fluid is flowing through the nozzle 24. The force of the fluid slurry acting on the bill portion 244 of the nozzle 24 to keep the nozzle 24 closed is illustrated by the arrows 250. In addition to any fluid force acting on the bill portion 244 and saddle portion 242 of the nozzle 24 to keep it closed during a period where them is no fluid flow therethrough, the resiliency of the nozzle 24 due the characteristics of the elastomeric material of the nozzle and any reinforcement material or means located therein additionally keep the nozzle 24 in a closed position.

Figure 7:
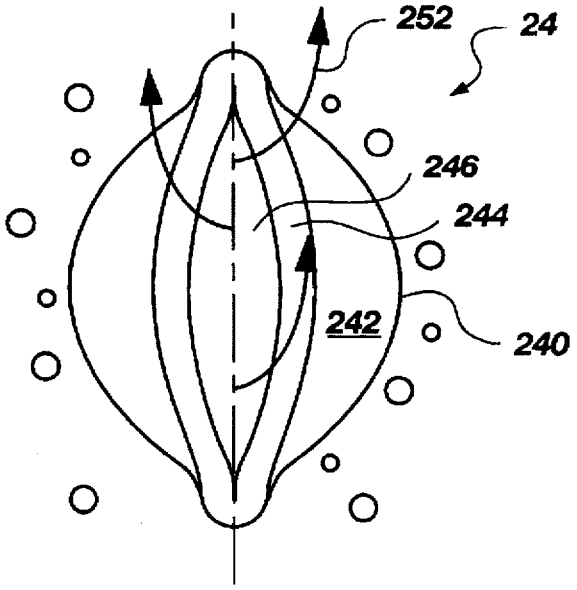
FIG. 7 is an end view of the check valve type nozzle of the sparger system of the present invention during operation thereof in a flotation column.

Referring to drawing FIG. 7, the nozzle 24 is shown when having fluid flowing therethrough of sufficient fluid pressure to cause the substantially longitudinal slit 246 to be opened. Since the nozzle 24 is resilient, the slit 246 does not fully open to a round or cylindrical configuration. The fluid flowing through the slit 246 of the nozzle 24 is represented by the arrows 252. Also, when fluid is flowing through the slit 246 of the nozzle 24, the saddle portion 242 retains its shape due to the resilient characteristics of the elastomeric material from which the nozzle is formed and any reinforcement located therein while the cuff portion substantially retains the shape of the sparger pipe 22 to which it is connected. Depending upon the flow rate and pressure of the fluid supplied to the nozzle 24 as the fluid flows through the slit 246 of the nozzle 24, the various types of reagents in the fluid flowing through the nozzle 24, and the characteristics and properties of the slurry surrounding the nozzle 24 will determine the desired size of diameter of bubbles for flotation purposes in the floatation separation column 10.

Figure 8A:
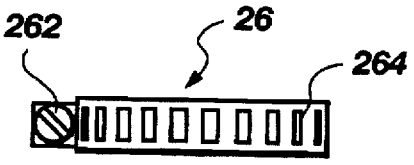
FIG. 8A is a top view of the retaining clamp for the check valve type nozzle of the sparger system of the present invention.
Figure 8B:
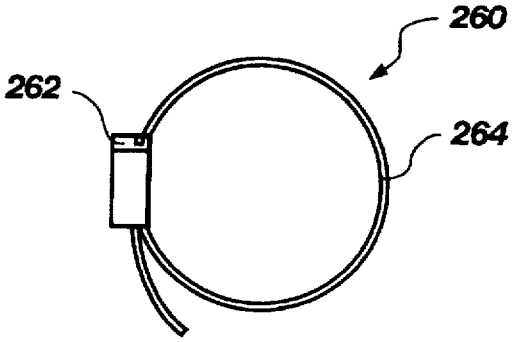
FIG. 8B is a side view of the retaining clamp for the check valve type nozzle of the sparger system of the present invention.

Referring to drawing FIGS. 8A and 8B, a suitable mechanical clamp 260 is shown to retain the nozzle 24 on the end of sparger pipe 22. The clamp 260 comprises any suitable mechanically actuated clamp such as a screw 262 retained on one end of a clamp member 264 engaging a plurality of apertures in the clamp member 264. Since the nozzle 24 resiliently engages the end 52 of sparger pipe 22, typically, only a small clamping force is required to retain the nozzle 24 on the end 52 of sparger pipe 22 so that a variety of clamps are suitable for use to retain the nozzle 24 on the end 52 of sparger pipe 22.

Referring to drawing FIGS. 1 through 3, if a nozzle 24 becomes damaged during use, the nozzle 24 may be replaced without shutting down the operation of the flotation separation column 10. To replace the nozzle 24 the compression seal 36 is loosened, but not removed from sparger pipe 22, by reducing the clamping force of the compression member 38 acting on the sparger pipe 22. Next, the sparger pipe 22 is pulled from the flotation column 10, through the valve assembly 32, until the nozzle 24 substantially abuts the compression seal 38. At this point, the ball valve member 72 is closed to prevent the flow of slurry from the floatation column 10. At this time, the compression fitting 36 and compression seal 38 of the compression fitting 34 are removed from the valve housing 70 of the valve assembly 32 thereby allowing the removal of the sparger pipe 22 and the nozzle 24 thereon. A new nozzle 24 may then be placed on the end 52 of the sparger pipe 22, the sparger pipe 22 inserted into a portion of the valve housing 72, and the compression assembly 34 reinstalled on the housing 70. The ball valve member 72 is opened allowing the sparger pipe 22 having nozzle 24 thereon to be inserted therethrough into the flotation column 10. At this juncture, the compression fitting 34 is tightened to seal around the exterior of the sparger pipe 22 to prevent slurry from flowing around the exterior of the sparger pipe 22. Since the nozzle 24 is held in a closed position by the fluid pressure surrounding the nozzle 24 and the resiliency of the material of the nozzle 24, during the nozzle replacement process no fluid slurry flows into the nozzle 24 and into and through the sparger pipe 22.

Additionally, fluid slurry from the flotation column 10 does not flow into the nozzle 24 if there is no fluid flow therethrough since the pressure of the fluid slurry keeps the nozzle in a closed position. In this manner, if there is a loss of fluid flow throughout the nozzle during the flotation process, the nozzle 24, sparger pipe 26, and supply pipe 46 do not become filled with fluid slurry from the flotation separation column 10 thereby allowing the simple restart of fluid flow through the sparger system assembly 20.

It can be easily seen that the sparger system assembly of the present invention offers the advantages over other sparger systems in that the nozzle 24 is a simple duck bill type check valve capable of satisfactory performance over a variety of operating conditions, is simple in construction, may be easily replaced during operation of the flotation separation column 10, is self-cleaning during operation, and is self regulating with respect to the flow therethrough.

It will be understood that additions, deletions, changes and modifications may be made to the present invention which fall within the scope thereof. For instance, any type of suitable valve assembly may be used, such as a gate type valve. Any suitable type of connection to the flotation separation column 10 for the sparger system assembly may be used, such as the valve assembly being welded to the column 10 directly without a connector assembly 22 being used. Any suitable type compression fitting 36 may be used. Any suitable type supply pipe 46 may be used. Also, rather than a duck bill type check valve being connected to the end of the sparger pipe, an elastomeric sleeve covering one or more plurality of apertures in the sparger pipe may be used as a check valve. Such an elastomeric type check valve operates in the same manner as the duck bill type check valve of the present invention and includes the same advantages.

What is claimed is:

1. In combination, a sparger assembly and a flotation separation column for the separation of a froth flotation concentration of minerals in a liquid/solid slurry located in said flotation separation column, said combination comprising:

said flotation separation column including a sidewall having at least one aperture therein, said flotation separation column having a central axis; and said sparger assembly comprising:

a sparger pipe having a first end in flow communication with a source of gas-containing fluid under pressure used in said froth flotation concentration of minerals in a liquid/solid slurry in said flotation separation column and extending to a second end in communication with said froth flotation separation concentration of minerals in a liquid/solid slurry in said flotation separation column, said sparger pipe having a portion thereof extending through the aperture in the sidewall of said flotation separation column, said sparger pipe having a portion thereof sealingly engaging a portion of the sidewall of said flotation separation column; and a self-regulating, self-cleaning resilient duck bill type check valve nozzle connected to the second end of the sparger pipe, the duck bill type check valve nozzle allowing the flow of gas-containing fluid under pressure therethrough into said froth flotation concentration of minerals in a liquid/solid slurry in said flotation separation column, substantially preventing the flow of said froth flotation concentration of minerals in a liquid/solid slurry from said flotation separation column into the sparger pipe, creating back pressure to the flow of fluid used in the froth flotation concentration of minerals in a liquid/solid slurry in said flotation separation column, and remaining substantially free of solid build-up from said froth flotation concentration of minerals in a liquid/solid slurry during the separation of said froth flotation concentration of minerals in a liquid/solid slurry in said separation flotation column.

2. The combination of claim 1, wherein the duck bill type check valve nozzle is formed of an elastomeric material resistant to abrasion from said froth flotation concentration of minerals in a liquid/solid slurry in said separation flotation column.

3. The combination of claim 2, wherein the duck bill type check valve nozzle includes a resilient reinforcement biasing the nozzle to a normally closed configuration creating back pressure to the flow of fluid used in the froth flotation concentration of minerals in a liquid/solid slurry in said flotation separation column and substantially preventing the flow of said froth flotation concentration of minerals in a liquid/solid slurry from said flotation separation column into the sparger pipe.

4. The combination of claim 1, wherein the duck bill type check valve nozzle includes a cuff portion connected to the second end of the sparger pipe, a saddle portion, and a bill portion, the bill portion having a slit therein extending substantially parallel to the central axis of said flotation separation column.

5. The combination of claim 1, wherein the duck bill type check valve nozzle includes a cuff portion having a substantially round bore therethrough connected to the second end of the sparger pipe, a substantially flexible saddle portion connected to the cuff portion extending in a substantially tapering configuration therefrom, and a substantially flexible bill portion connected to the saddle portion having, in turn, a slit therein at the outlet thereof allowing the flow of fluid under pressure therethrough into said froth flotation concentration of minerals in a liquid/solid slurry in said flotation separation column.

6. The combination of claim 1, wherein the duck bill type check valve nozzle includes:

a bill portion having an outlet and a width, the bill portion including a slit therein at the outlet thereof allowing the flow of fluid under pressure therethrough into said froth flotation concentration of minerals in a liquid/solid slurry in said flotation separation column, wherein the slit includes a length substantially in the range of substantial one-eighth inch in length to a length of substantially the full width of the bill portion of the duck bill type check valve.

7. The combination of claim 1, further comprising:

a valve connecting the source of gas-containing fluid under pressure and the sparger pipe, the valve controlling the supply of gas-containing fluid under pressure to said sparger assembly.

8. The combination of claim 7, further comprising:

a compression fitting assembly including a compression seal therein for effecting a sealing engagement across the compression fitting assembly when assembled around the sparger pipe to prevent the flow from said froth flotation concentration of minerals in a liquid/solid slurry during the separation of said froth flotation concentration of minerals in a liquid/solid slurry in said separation flotation column.

9. In combination, a sparger assembly and a flotation separation column for the separation of a froth flotation concentration of minerals in a liquid/solid slurry in said flotation separation column, said flotation separation column having an aperture in the sidewall thereof, said combination comprising:

said flotation separation column including a central axis extending therethrough; and said sparger assembly comprising:

a sparger pipe having a first end in flow communication with a source of gas-containing fluid under pressure used in said froth flotation concentration of minerals in a liquid/solid slurry in said flotation separation column and extending to a second end in communication with said froth flotation separation concentration of minerals in a liquid/solid slurry in said flotation separation column, said sparger pipe having a portion thereof extending through said aperture in the sidewall of said flotation separation column, said sparger pipe having a portion thereof sealingly engaging a portion of the sidewall of said flotation separation column; and a self-regulating, self-cleaning resilient duck bill type check valve nozzle connected to the second end of the sparger pipe, the check valve type nozzle allowing the flow of gas-containing fluid under pressure therethrough into said froth flotation concentration of minerals in a liquid/solid slurry in said flotation separation column, substantially preventing the flow of said froth flotation concentration of minerals in a liquid/solid slurry from said flotation separation column into the sparger pipe, creating back pressure to the flow of fluid used in the froth flotation concentration of minerals in a liquid/solid slurry in said flotation separation column, and remaining substantially free of solid build-up from said froth flotation concentration of minerals in a liquid/solid slurry during the separation of said froth flotation concentration of minerals in a liquid/solid slurry in said separation flotation column.

10. The combination of claim 9, wherein the duck bill type check valve nozzle is formed of an elastomeric material resistant to abrasion from said froth flotation concentration of minerals in a liquid/solid slurry in said separation flotation column.

11. The combination of claim 10, wherein the duck bill type check valve nozzle includes a resilient reinforcement biasing the nozzle to a normally closed configuration creating back pressure to the flow of fluid used in the froth flotation concentration of minerals in a liquid/solid slurry in said flotation separation column and substantially preventing the flow of said froth flotation concentration of minerals in a liquid/solid slurry from said flotation separation column into the sparger pipe.

12. The combination of claim 9, wherein the duck bill type check valve nozzle includes a cuff portion connected to the second end of the sparger pipe, a saddle portion, and a bill portion allowing the flow of fluid under pressure therethrough into said froth flotation concentration of minerals in a liquid/solid slurry in said flotation separation column, substantially preventing the flow of said froth flotation concentration of minerals in a liquid/solid slurry from said flotation separation column into the sparger pipe, creating back pressure to the flow of fluid used in the froth flotation concentration of minerals in a liquid/solid slurry in said flotation separation column, and remaining substantially free of solid build-up from said froth flotation concentration of minerals in a liquid/solid slurry during the separation of said froth flotation concentration of minerals in a liquid/solid slurry in said separation flotation column.

13. The combination of claim 9, wherein the duck bill type check valve nozzle includes a cuff portion having a substantially round bore therethrough connected to the second end of the sparger pipe, a substantially flexible saddle portion connected to the cuff portion extending in a substantially tapering configuration therefrom, and a substantially flexible bill portion connected to the saddle portion having, in turn, substantially a slit therein at the outlet thereof allowing the flow of fluid under pressure therethrough into said froth flotation concentration of minerals in a liquid/solid slurry in said flotation separation column, the slit extending substantially parallel to the central axis of said flotation separation column.

14. The combination of claim 9, further comprising:

a first valve connecting the source of gas-containing fluid under pressure and the sparger assembly controlling the flow of gas-containing fluid under pressure to the sparger assembly.

15. The combination of claim 14, further comprising:

a compression fitting assembly including a compression seal therein for effecting a sealing engagement across the compression fitting assembly when assembled around the sparger pipe to prevent the flow from said froth flotation concentration of minerals in a liquid/solid slurry during the separation of said froth flotation concentration of minerals in a liquid/solid slurry in said separation flotation column.

16. The combination of claim 9, further comprising:

a connector assembly connected to said aperture in said flotation separation column and connected to one end portion of a second valve assembly, the sparger pipe extending through the connector assembly into said liquid/solid slurry in said flotation separation column.

17. The combination of claim 9, further comprising:

a second valve assembly including a valve housing including a bore therethrough and a valve body located within the valve housing, the valve assembly having one end connected to the aperture in the sidewall of said flotation separation column, the sparger pipe extending through the second valve assembly, the second valve assembly controlling the flow of the froth flotation concentration of minerals in a liquid/solid slurry from said flotation separation column allowing the removal of the sparger assembly from the flotation separation column.

18. The combination of claim 17, further comprising:

a compression fitting assembly including a compression seal therein for effecting a sealing engagement across the compression fitting assembly when assembled around the sparger pipe, the compression fitting assembly connected to the other end of the second valve assembly to prevent the flow from said froth flotation concentration of minerals in a liquid/solid slurry during the separation of said froth flotation concentration of minerals in a liquid/solid slurry in said separation flotation column.

19. In combination, a sparger assembly and an aeration device for the flotation separation of a first material from a second material in a mixture containing said first material and said second material located in said aeration device, said combination comprising:

said aeration device for the flotation separation of a first material from a second material in a mixture located therein including a wall having at least one aperture therein; and said sparger assembly comprising:

a sparger pipe having a first end in flow communication with a source of gas-containing fluid under pressure used in said flotation separation of a first material from a second material in a mixture in said aeration device and extending to a second end in communication with said flotation separation of a first material from a second material in a mixture in said aeration device, said sparger pipe having a portion thereof extending through the aperture in the wall of said aeration device, said sparger pipe having a portion thereof sealingly engaging a portion of the wall of said aeration device; and a self-regulating, self-cleaning resilient duck bill type check valve nozzle connected to the second end of the sparger pipe, said resilient duck bill type check valve nozzle allowing the flow of gas-containing fluid under pressure therethrough into said aeration device for the flotation separation of a first material from a second material in a mixture in said aeration device, substantially preventing the flow of said mixture from said aeration device into the sparger pipe, creating back pressure to the flow of fluid used in the flotation separation of a first material from a second material in said mixture in said aeration device, and remaining substantially free of build-up of said mixture during the flotation separation of said first material from said second material in said mixture in said aeration device.

20. The combination of claim 19, wherein the duck bill type check valve nozzle includes a cuff portion connected to the second end of the sparger pipe, a saddle portion, and a bill portion, the bill potion having a slit therein at the outlet thereof allowing the flow of fluid under pressure therethrough into said mixture in said aeration device.

21. The combination of claim 19, further comprising:

a valve connecting the source of gas-containing fluid under pressure and the sparger pipe, the valve controlling the supply of gas-containing fluid under pressure to said sparger assembly.

22. The combination of claim 21, further comprising:

a compression fitting assembly including a compression seal therein for effecting a sealing engagement across the compression fitting assembly when assembled around the sparger pipe to prevent the flow of said mixture during said flotation separation of a first material from a second material in a mixture in said aeration device.

23. The combination of claim 22, further comprising:

a connector assembly connected to said aperture in said aeration device, the sparger pipe extending through the connector assembly into said mixture in said aeration device.

24. The combination of claim 23, further comprising:

a second valve assembly including a valve housing including a bore therethrough and a valve body located within the valve housing, the valve assembly having one end connected to the connector connected to the aperture in the wall of said aeration device, the sparger pipe extending through the second valve assembly, the second valve assembly controlling the flow of said mixture from said aeration device thereby allowing the removal of said sparger assembly from said aeration device.

* * * * *

UNITED STATES PATENT AND TRADEMARK OFFICE

CERTIFICATE OF CORRECTION

PATENT NO. : 5,676,823

DATED : October 14, 1997

INVENTOR(S) : McKay et al

It is certified that error appears in the above-identified patent and that said Letters Patent is hereby corrected as shown below:

Title page, item [56],

Under U.S. Patent Documents, change "Mail" to --Mail et al.--;
change "Mail" to --Mail et al.--;
change "3/1972" to --2/1972--;
change "Schrit" to --Schmit et al.--;
change "Raftis" to --Raftis et al.--;
change "Raftis" to --Raftis et al.--;
change "Yoon" to --Yoon et al.--;

| | |
|---|---|
| Column 2, line 49 | after "Fig. 3 is" insert --a--; |
| Column 4, line 31 | change "comprises and" to --comprises an--; |
| Column 4, line 65 | change "connector body 44" (first occurrence) to --connector receptacle 42--; |
| Column 5, line 31 | after "to the" delete --to the--; |
| Column 5, line 44 | change "potion" to --portion--; |
| Column 5, line 63 | change "potion" to --portion--; |

UNITED STATES PATENT AND TRADEMARK OFFICE

CERTIFICATE OF CORRECTION

PATENT NO. : 5,676,823

DATED : October 14, 1997

INVENTOR(S) : McKay et al.

It is certified that error appears in the above-identified patent and that said Letters Patent is hereby corrected as shown below:

| | |
|---|---|
| Column 6, line 4 | change "them" to --there--; |
| Column 6, line 5 | after "due" insert --to--; |
| Column 7, line 6 | change "pipe 26" to --pipe 22--; |
| Column 7, line 11 | after "offers" delete --the--; |
| Column 7, line 25 | change "assembly 22" to --assembly 26--; |
| Column 11, line 26 | change "potion" to --portion--. |

Signed and Sealed this

Twenty-second Day of September, 1998

*Attest:*

Bruce Lehman

BRUCE LEHMAN

*Attesting Officer*

*Commissioner of Patents and Trademarks*